US006050012A

United States Patent [19]

Greenfield

[11] Patent Number: 6,050,012

[45] Date of Patent: Apr. 18, 2000

[54] PANEL-JOINING BRACKET

[76] Inventor: Peter M. Greenfield, 3682 Tanglewood Ct., Ann Arbor, Mich. 48105

[21] Appl. No.: 08/888,779

[22] Filed: Jul. 7, 1997

[51] Int. Cl.[7] ..... G09F 13/04

[52] U.S. Cl. ..... 40/564; 40/572; 52/732.1

[58] Field of Search ..... 40/564, 572, 574; 248/218.4, 219.3; 52/282.1, 287.1, 732.1, 737.6

[56] References Cited

U.S. PATENT DOCUMENTS

| | | | |
|---|---|---|---|
| D. 205,209 | 7/1966 | Priddis . | |
| D. 271,984 | 12/1983 | Nelson et al. . | |
| D. 277,298 | 1/1985 | Nelson . | |
| D. 277,299 | 1/1985 | Nelson . | |
| D. 290,620 | 6/1987 | Elmer . | |
| D. 315,928 | 4/1991 | Flieder . | |
| D. 331,198 | 11/1992 | Nickerson . | |
| D. 350,369 | 9/1994 | Shafley . | |
| D. 357,944 | 5/1995 | Atwell et al. . | |
| D. 373,000 | 8/1996 | Brady . | |
| D. 382,910 | 8/1997 | Greenfield . | |
| 882,835 | 3/1908 | McGillivray | 248/219.3 X |
| 1,407,874 | 2/1922 | Michalski | 40/574 |
| 1,426,240 | 8/1922 | Zienner | 40/574 X |
| 1,700,383 | 1/1929 | Smigielski | 40/564 X |
| 1,713,386 | 5/1929 | Kelley | 40/574 |
| 1,885,776 | 11/1932 | Smith . | |
| 2,188,404 | 1/1940 | Hengel | 40/564 |
| 2,423,722 | 7/1947 | Nilson | 52/287.1 X |
| 2,559,163 | 7/1951 | MacDonald . | |
| 2,825,799 | 3/1958 | Julien . | |
| 2,895,246 | 7/1959 | Menges | 248/219.3 X |
| 3,113,552 | 12/1963 | Spooncer . | |
| 3,264,020 | 8/1966 | De Ridder | 52/282.1 |
| 3,284,938 | 11/1966 | Diehl et al. . | |
| 3,290,813 | 12/1966 | Rose, Sr. . | |
| 3,440,748 | 4/1969 | Hackley . | |
| 3,633,299 | 1/1972 | Westin . | |
| 3,828,456 | 8/1974 | Rose . | |
| 3,947,985 | 4/1976 | Skrzypczak . | |
| 3,984,069 | 10/1976 | Heyworth | 40/572 X |
| 4,052,806 | 10/1977 | George . | |
| 4,613,847 | 9/1986 | Scolari et al. . | |
| 4,667,428 | 5/1987 | Elmer | 40/592 |
| 4,686,505 | 8/1987 | Vanderburg | 40/564 X |
| 4,901,461 | 2/1990 | Edwards et al. | 40/575 |
| 5,084,994 | 2/1992 | Elmer | 40/591 |
| 5,134,550 | 7/1992 | Young | 362/32 |
| 5,470,054 | 11/1995 | Bohrman | 248/218.4 X |
| 5,737,887 | 4/1998 | Smeenge | 52/282.2 |

FOREIGN PATENT DOCUMENTS

| | | | |
|---|---|---|---|
| 2214691 | 9/1989 | United Kingdom | 40/564 |

OTHER PUBLICATIONS

P.I.R. Triangle Pole Light, Gearex Corporation Present Aug. 15, 1995.

*Primary Examiner*—Joanne Silbermann
*Attorney, Agent, or Firm*—Young & Basile, P.C.

[57] ABSTRACT

An internally lit address sign for mounting near the street for easy viewing by passing vehicles, and for comprising an aesthetically pleasing, fixture-like appearance which enhances the overall landscape or architecture of the residence or business which it identifies. The sign has two angled front faces facing the street for an angled display of the address to vehicles approaching from either side. The sign is preferably formed with the appearance of an elongated, upright post with the address located near the top of the sign. The sign may additionally include an emergency flashing light which can be selectively actuated by an alarm or the occupants of the residence of business.

2 Claims, 2 Drawing Sheets

PANEL-JOINING BRACKET

FIELD OF THE INVENTION

The present invention is in the field of address signs for residences and businesses, and more particularly internally illuminated signs of this type.

BACKGROUND OF THE INVENTION

It is a common problem for drivers to find and read the addresses of residences and businesses while driving, especially at night. One known solution to this problem is to internally illuminate the address from within a hollow sign housing, usually having a flat rectangular shape for mounting to the wall of a house or hanging from a lamppost. Another known solution is to place the address sign closer to the road, rather than mounting it directly on the building. In some cases, signs which have been separated from the building and moved closer to the road, for example attached to a mailbox or mounted in the yard at the edge of the street, have also been internally illuminated to further aid recognition at night.

An example of an internally illuminated address sign located on a house is shown in U.S. Pat. No. 2,798,323 to Witz. It has a hollow housing with an internal lamp and a partially translucent or transparent front face.

U.S. Pat. No. 4,843,525 to Williams discloses an internally illuminated address sign mounted in a yard with a number of ground piercing stakes. The sign is additionally solar powered.

Another solar powered illuminated yard marker is disclosed in U.S. Design Patent No. 315,928 to Flieder. A conventionally powered illuminated yard sign is disclosed in U.S. Design Patent No. 307,768 to Levin, again having a relatively one-dimensional hollow housing with a yard mounting stake. U.S. Design Patent No. 250,913 to Kozial discloses an internally lit address sign attached to a lamppost. U.S. Pat. No. 5,143,285 to Wise discloses a hollow mailbox post with transparent windows on two sides for address information and an elongated bulb in the post for internal illumination of the address.

These prior patents do not fully address the need for an internally illuminated address sign which can be easily read by drivers approaching from either side of the street, is weather-resistant, is simple to make, and is an attractive structural addition to a yard.

SUMMARY OF THE INVENTION

The present invention is an upright, freestanding, internally illuminated address sign for placement in a yard or otherwise near the street in association with a residence or business. The sign housing has at least two angled, adjacent, internally-illuminated address-displaying faces with the overall shape of an elongated post; the address-display on each face being located near the top of the post (i.e., on the upper third). In a preferred form the post is triangular in cross-section.

The post has at least one rear access panel providing suitable access to the interior of the housing, for example to replace a bulb, and two street-side panels with translucent address characters, for example a house number, at their upper ends. The rear access panel is preferably located facing the house and not readily visible from the street, with the front panels facing opposite directions up and down the street at an acute angle thereto. In a preferred form the angle of the front address panels is approximately 60° relative to the street.

In a further form a selectively activated internal emergency flasher or beacon is visible from a window or windows on all sides of the housing (both streetside and house-side), which can be turned on to draw the attention of a vehicle trying to locate the house, for example an ambulance, police car, fire truck or delivery person (e.g., pizza driver).

In yet a further form the house-side faces of the housing are provided with translucent or transparent safety windows to mark the location of the housing at night and provide general illumination of the ground. This is especially useful for drivers backing out of a driveway.

These and other aspects of the invention will become apparent upon a further reading of the specification.

DETAILED DECRIPTION OF THE ILLUSTRATED EMBODIMENT

Figure 1:
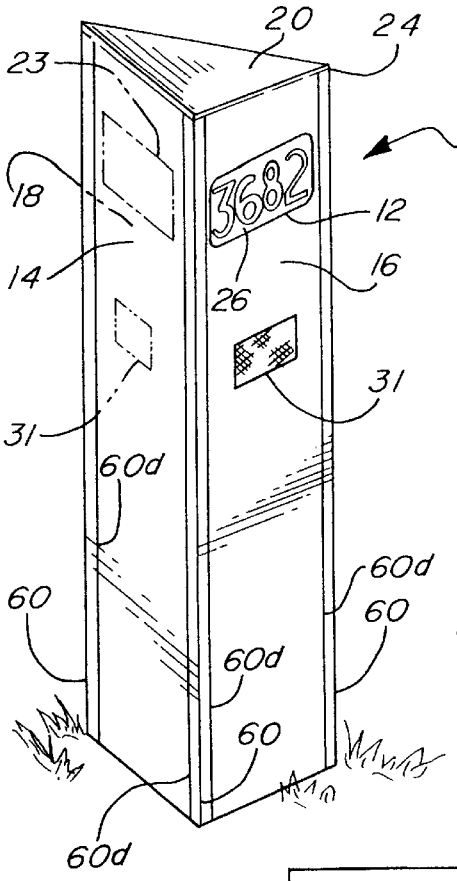
FIG. 1 is a rear perspective view of a sign according to the present invention, mounted in a yard.
Figure 2:
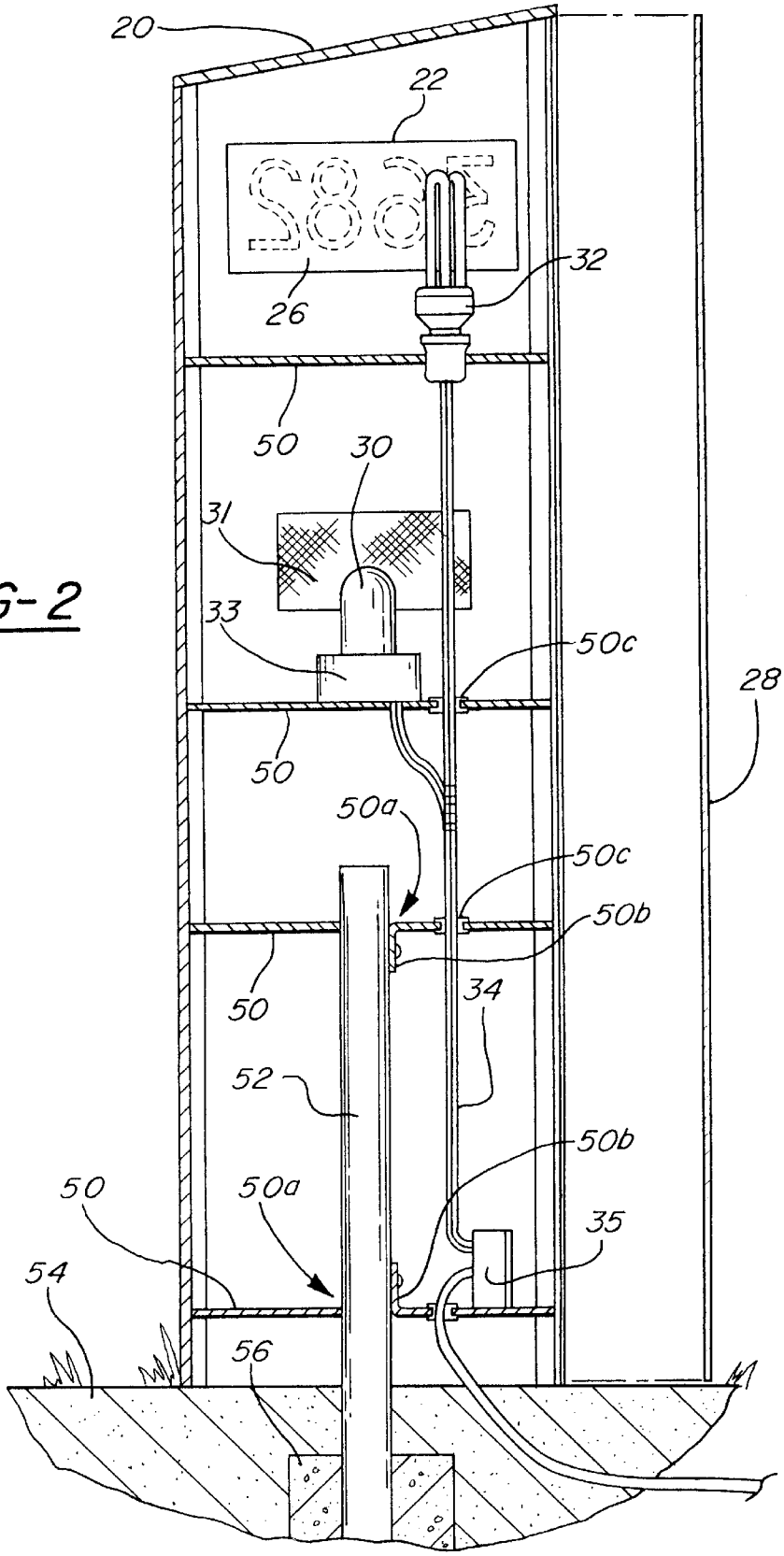
FIG. 2 is a side section view of the sign in FIG. 1, showing internal detail of the support structure, lighting components and address display.

Referring first to FIGS. 1 and 2, a sign 10 according to the present invention is shown comprising an upright, freestanding housing preferably (but not necessarily) having a triangular cross-section. The housing in the illustrated embodiment includes a rear access panel 14, a left front panel 16, a right front panel 18, and a top panel 20. The sign further includes an address window 22 on each of the front panels 16, 18, the address window defining a number of internally lit address characters 24 supported in the window on a panel 26. While the illustrated embodiment shows an opaque window 22 with translucent or transparent characters 24, it is also possible to use a translucent or transparent window 22 and opaque characters 24.

Rear access panel 14 includes or entirely comprises a removable plate or door 28, best shown in FIG. 2, which can be removed from back panel 14 for interior access and maintenance.

Figure 4:
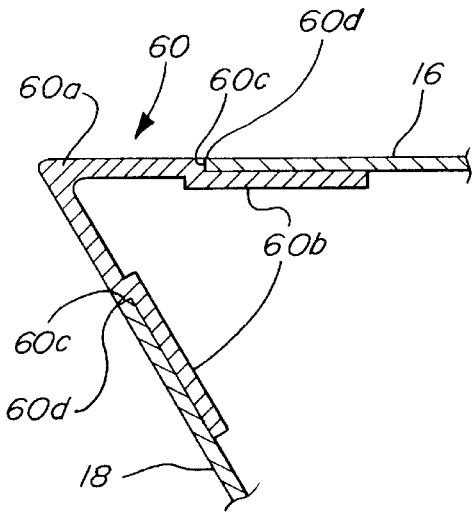
FIG. 4 is a top plan section view of a corner of the sign of FIG. 1.

Sign 10 is generally hollow, as best shown in FIG. 2, and the panels 14, 16, 18, and 20 are formed from suitable weather-resistant, lightweight, structurally rigid material such as aluminum sheet metal. The junction of the panels is sealed to make the interior of sign 10 watertight. The panels may be joined by welding, adhesive, mechanical interlock, or other known methods; a preferred corner bracket structure is illustrated in FIG. 4 and described below. The panels may also be formed from alternate materials such as plastic, wood or other metals.

Referring to FIGS. 1 and 2, sign 10 is an upright, freestanding structure which can be secured to the ground, preferably using the novel hollow-structure supporting arrangement illustrated in FIG. 2. The interior of sign 10 is provided with one or more horizontal shelves 50 which preferably match the cross-section of the interior of sign 10, for example made from sheets or panels of the same aluminum used for the outer walls of the sign housing. At least one, and preferably two of the lowermost shelves 50 are provided with apertures 50*a* formed by cutting a tab portion 50*b* in the shelf material and bending it up or down toward the rear access panel 28. Sign 10 can then be mounted in sliding fashion over a support post 52 anchored at its lower end in ground 54, preferably in a concrete anchor 56 buried in the ground. Tab portions 50*b* not only make an aperture for post 52 when they are bent out of the way, but they provide a convenient, inexpensive fastening surface for a bolt, screw or clamp to vertically lock sign 10 to post 52. By bending tabs 50*b* rearwardly toward access panel 28, the locking means (bolt, screw or clamp) can conveniently be reached and tightened or loosened as needed.

The above-described attachment of sign 10 to post 52 via the internal shelf or panel portions 50 provides a theft-, wind- and collision-resistant support for the sign. The use of one or more shelves 50 which match the cross-section of the sign housing also adds rigidity and strength to the hollow sign in addition to their above-described attachment function and their lighting support functions described below.

Address windows 22 formed in the right and left front panels of sign 10 are illustrated as rectangular cutouts closed from the interior by address support panels 26 with translucent address numbers or characters 24. In the illustrated embodiment address support panel 26 is a sheet of metal similar to the metal in panels 16, 18, with the address numerals cut from the metal and then overlaid from behind with push through flush numerals made from a translucent plastic. In an alternate embodiment a solid support panel 26 of translucent material is used, with all but the address numerals 24 painted, in the manner of a reversed stencil. In yet a further alternate form, the address numbers 24 can be cut directly from panel 16, 18 and backed from the inside with a translucent piece of sealing plastic. Whatever particular structure or material used, the address numerals should be at least translucent, and the mating surfaces of front panels 16, 18, support panel 26 and/or any translucent overlay on the address 24 should be sealed with gasketing or adhesives to make them watertight.

Address support panels 26 can be permanently mounted to sign 10, for example by welding, or alternately can be removable, for example using a removable adhesive or a mechanical connection such as a snap—or slide-fit with associated structure on the inside of the sign.

Internal illumination is provided by a conventional electric light 32, for example an incandescent or fluorescent bulb, mounted to uniformly illuminate the translucent address information. The light 32 is mounted in an aperture on uppermost support shelf 50 and preferably located at the height of the address windows to ensure bright, uniform illumination. Power is supplied from a standard cord or conduit 34 leading from light 32 through suitable openings 50*c* in shelves 50 through an optional junction box 35 to a suitable power supply in the residence. In the illustrated embodiment cord 34 is shown extending through bottom shelf 50, from where it continues underground to the house to avoid marring the landscape and to protect it from damage.

Emergency flasher 30 is an intermittently flashing bulb or strobe light, also powered by electricity from conduit 34 and selectively controlled from the residence. Flasher 30 can alternately be connected to a burglar alarm in the residence or business, automatically activated to flash when the alarm is tripped. Flasher 30 is illustrated as a DC powered unit, with a converter 33 from power cord 34.

Flasher 30 is preferably located on another interior support shelf 50 in the sign housing, adjacent at least two translucent or transparent emergency windows 31, one on each of the street-facing panels 16, 18 so as to be visible by ambulance crews or police far down the street, long before the address or even the house is in view. Additional windows may be used on the rear side or sides to provide a signal visible even from a street or location behind the house.

Optionally, at least one rear house-side panel is provided with a nighttime visibility window 23, which transmits light from the main address window light.

Window 23 not only marks the location of the sign at night, for example for a driver backing out of the driveway, but also sheds light on the adjacent ground for general illumination.

Access to the interior of sign 10 for routine maintenance or cleaning is through rear access panel 28, in the illustrated embodiment a full length panel. In the illustrated embodiment access panel 28 comprises the entire rear panel of sign 10, and is fastened to the sign with machine screws on both sides of the panel so that it can be pulled entirely away from the sign. It would also be possible to provide a hinge connection for the sign, although this would increase cost and complexity.

The upright, elongated post shape of sign 10, particularly in a triangular configuration as illustrated, has been found to be an aesthetically pleasing design, with clean lines and a sturdy, fixture-like appearance.

Apart from the aesthetically pleasing nature of the overall post shape, the acutely angled presentation of two front panels 16, 18 to the street provides optimal viewing by passing drivers approaching from either side. While the illustrated embodiment presents front panel 16, 18 to the street in an overall triangular sign configuration, it is also possible to use different configurations, provided that two faces are presented to opposite ends of the street at an acute angle.

Figure 3:
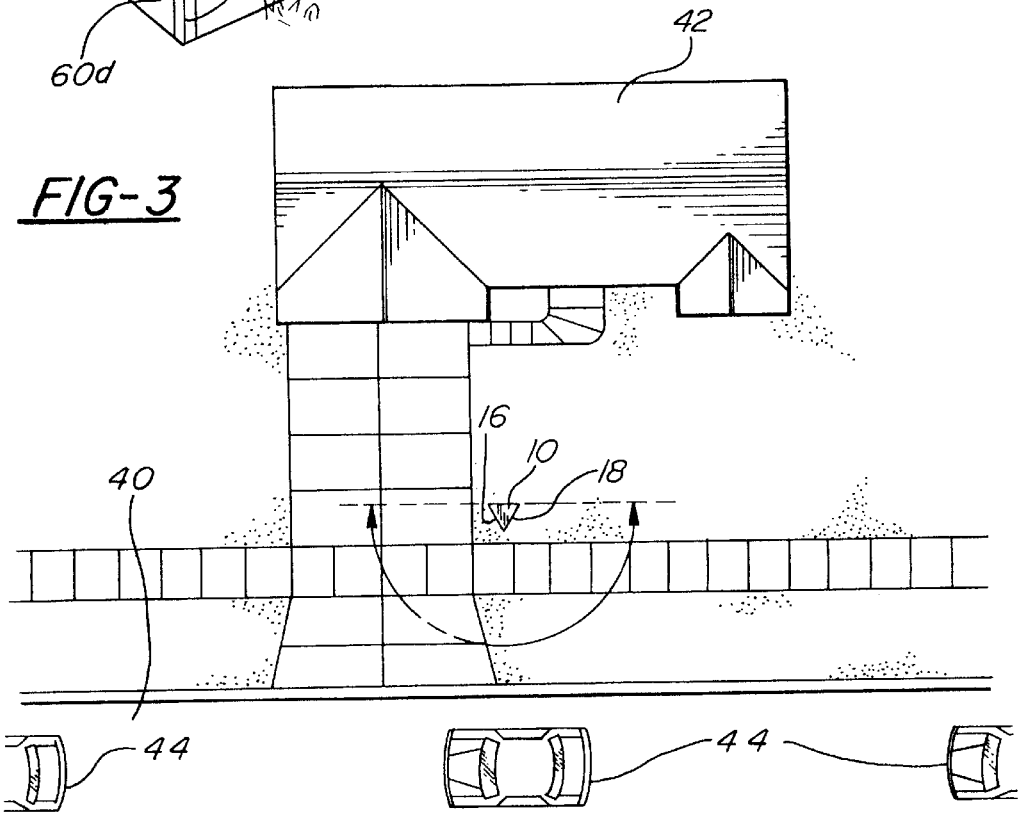
FIG. 3 is a plan view of a sign according to the present invention, located in a preferred orientation relative to the street.

Referring to FIG. 3, sign 10 is shown in a preferred orientation relative to street 40 and the residence or business 42 identified by the address on sign 10. Panels 16, 18 face street 40 at an acute angle, for example approximately 60° to the street as illustrated in FIG. 3. It can be seen that whatever the position of an approaching car 44, the internally illuminated address on front panels 16, 18 will be clearly visible, whether the car is far down the street or directly opposite the residence 42.

It will additionally be appreciated that the simple, clean lines and the upright, elongated shape of sign 10 presents a more ornamental appearance than the squat, box-like structures shown in the prior art. When constructed and finished properly, sign 10 looks like an integral structural component of the landscape.

A preferred method for joining the sign panels 14, 16, 18 is illustrated in FIG. 4, which is a plan section view of one corner of the sign structure using a novel, triangular corner bracket 60 with a generally arrowhead shaped exterior point 60*a* which forms the outer corner of sign 10 visible in FIG. 1, and recessed panel-supporting legs 60*b* defining a step 60*c* with arrowhead shaped exterior point 60*a*. Side panels, for example panels 16 and 18 as illustrated in FIG. 4, fit flush with exterior point 60*a*, connected by a suitable adhesive to an outer surface of each recessed panel-supporting leg 60*b* hidden in the interior of sign 10 when it is assembled. The resulting exterior finish of the sign where the sign panels 14, 16 and 18 are joined is thus a smooth, flush, nearly seamless (if properly finished) joint 60*d* which is somewhat exaggerated in FIG. 1 for purposes of illustration. In actual practice, if the coloring and material of brackets 60 and side panels

14, 16, 18 are carefully matched, the seam is only subtly visible and presents an aesthetically pleasing appearance. Besides the aesthetically pleasing appearance of corners formed with bracket 60, bracket 60 also allows for more economical, simpler construction of the sign by eliminating complicated joints and finishing operations where the side panels 14, 16 and 18 meet. Moreover, the full-length, continuous brackets 60, extending from the top to the bottom of the sign, provide structural rigidity.

It should be understood by those skilled in the art that the foregoing is a description of an illustrative embodiment for purposes of providing a disclosure under 35 U.S.C. §112, and is not intended to be limiting beyond the scope of the following claims.

I accordingly claim:

1. A triangular corner assembly for a paneled structure, comprising:

a panel-joining bracket for creating an acutely angled corner between two panels, the bracket having a generally arrowhead-shaped exterior point formed by the junction of two integral legs set at an acute angle to one another, and further defined by a recessed panel-supporting portion of each leg at a free end thereof, which recessed panel-supporting portion is parallel to the adjacent portion of each leg in the arrowhead shaped exterior point and defines an exterior-facing step between the arrowhead-shaped exterior point and the panel-supporting leg portion, which step has a depth adapted to receive an edge of a panel in a flush fit with the arrowhead shaped exterior point; and, two essentially flat panels, each panel having an edge secured to one of the recessed panel-supporting portions of the bracket, such that an exterior surface of each panel is essentially flush with an adjacent exterior surface of the arrowhead shaped exterior point.

2. A method for creating a triangular paneled structure, comprising:

providing three corner brackets, each bracket having a generally arrowhead-shaped exterior point formed by the junction of two integral legs set at an acute angle to one another, and further defined by a recessed panel-supporting portion of each leg at a free end thereof, which recessed panel-supporting portion is parallel to the adjacent portion of each leg in the arrowhead shaped exterior point and defines an exterior-facing step between the arrowhead-shaped exterior point and the panel-supporting leg portion, which step has a depth adapted to receive an edge of a panel in a flush fit with the arrowhead shaped exterior point;

providing three essentially flat, rectangular, identical panels; and, securing the side edges of the three panels to the recessed panel-supporting leg portions of each bracket in a flush fit with the arrowhead-shaped exterior point thereof, such that the resulting triangular paneled structure has three corners characterized by a seamless point and a flush joint with the adjacent panels.

* * * * *